United States Patent [19]

Hiratsuka et al.

[11] Patent Number: 5,010,832

[45] Date of Patent: Apr. 30, 1991

[54] QUICK FEED DRIVE UNIT HAVING AN ELECTROMAGNETIC CLUTCH, A WORM, WORM WHEEL, AND PATTERN WHEEL FOR FEEDING A SEWN CLOTH IN A PERFORATING SEWING MACHINE

[75] Inventors: Katsuo Hiratsuka; Yoshiyuki Odaka; Takeshi Yoshida, all of Tochigi, Japan

[73] Assignee: SSMC Inc., Edison, N.J.

[21] Appl. No.: 410,788

[22] Filed: Sep. 22, 1989

[30] Foreign Application Priority Data

Oct. 20, 1988 [JP] Japan ..... 63-136174[U]

[51] Int. Cl.[5] ..... D05B 3/00; D05B 3/04; D05B 3/06; D05B 69/10

[52] U.S. Cl. ..... 112/68; 112/65; 112/66; 112/67; 112/220

[58] Field of Search ..... 112/65, 66, 67, 68, 112/220

[56] References Cited

U.S. PATENT DOCUMENTS 3,832,961 9/1974 Nakamura ..... 112/220
3,908,568 9/1975 Fujii ..... 112/67
4,570,555 2/1986 Reinke ..... 112/67
4,727,817 3/1988 Sakuma ..... 112/65

FOREIGN PATENT DOCUMENTS 4534623 8/1967 Japan .

*Primary Examiner*—Werner H. Schroeder
*Assistant Examiner*—Ismael Izaguirre
*Attorney, Agent, or Firm*—Theodore Jay

[57] ABSTRACT

A quick feeding shaft is rotatably supported at a bed of a perforating sewing machine. A quick feeding shaft rotatable in one direction and has one end coaxially connected to a magnetic clutch shaft and the other end coaxially connected to one end of a quick feeding shaft body provided with a worm. A magnetic clutch is secured coaxially to the magnetic clutch shaft and operatively connects the magnetic clutch shaft to the quick feeding shaft. A pattern wheel shaft is disposed at right angles to the quick feeding shaft and has a pattern wheel for feeding a sewn cloth quickly. A worm wheel coaxially secured thereto at an intermediate portion thereof to mesh with the worm. The worm wheel and the worm form a gear mechanism for transmitting the rotational driving force of the quick feeding shaft to the pattern wheel shaft.

2 Claims, 4 Drawing Sheets

QUICK FEED DRIVE UNIT HAVING AN ELECTROMAGNETIC CLUTCH, A WORM, WORM WHEEL, AND PATTERN WHEEL FOR FEEDING A SEWN CLOTH IN A PERFORATING SEWING MACHINE

BACKGROUND OF THE INVENTION

1. Field of the Invention

There are two types of perforating sewing machines. In the first type cloth is perforated in an earlier step and is hereinafter referred to as the earlier perforation type machine; in the second type, cloth is perforated in a later step and is hereinafter referred to as the later perforation type machine.

The present invention relates to a quick feeding driving unit in a perforating sewing machine which combines functions of earlier and later perforation types.

2. Description of Prior Art

One cycle of a series of successive perforating operations in the earlier perforation type machine comprises "SEWN CLOTH CLAMPING STEP", "BUTTON PERFORATING STEP", "CLOTH TENSIONING STEP", "FIRST QUICK FEEDING STEP", "SEWING STEP", "SECOND QUICK FEEDING STEP" and "SEWN CLOTH CLAMPING AND RELEASING STEP". One comparable cycle in the later perforation type machine comprises "SEWN CLOTH CLAMPING STEP", "CLOTH TENSIONING STEP", "FIRST QUICK FEEDING STEP", "SEWING STEP", "SECOND QUICK FEEDING STEP", "BUTTON PERFORATING STEP" and "SEWN CLOTH CLAMPING AND RELEASING STEP".

There is a difference between the earlier perforation type and the later perforation type in respect of that portion of one cycle of the operation which includes "FIRST AND SECOND QUICK FEEDING STEPS".

A conventional perforating sewing machine of the earlier perforation type is provided, as shown in FIG. 3, with a quick feeding crank shaft 2' rotatably supported by a bed 9 of a sewing machine. The quick feeding crank shaft 2' is always rotated during the operation of the sewing machine since a quick feeding gear 1 is rotatably driven in one direction by a rotational driving source (not shown). A worm wheel 4 fixed to one end of a cylinder member 27'A mounted on a pattern wheel shaft 27' rotatably supported by the bed 9 is meshed with a worm 3. An outer wheel 5*a* of a clutch 5 is secured by screw 6 to the other end of cylinder 27'A. The outer wheel 5*a* is always rotated during the operation of the sewing machine via the worm 3, the worm wheel 4 and the cylindrical member 27'A. A pattern wheel 28 is attached to the other end portion 27'B of the pattern wheel shaft 27'. The clutch 5 is, as illustrated in detail in FIGS. 4(*a*), 4(*b*), directed in one way and has a plurality of rollers 24 each urged in the direction of connection thereof by a spring 25 in the position between a plurality of cam surfaces 26*a* of a plurality of quick feeding clutch roller carriers 26 respectively fixed to the outer wheel 5*a* and the pattern wheel shaft 27'.

The first and the second quick feeding steps in the earlier perforation type sewing machine is described below.

As shown in FIG. 3, a cutting driving wheel is driven each time the sewn cloth is subjected to the perforating operation at the time of "BUTTON PERFORATING STEP" so that a cam 7*a* (projection) attached to the cutting driving wheel 7 pushes a roller 10*a* in the direction of the arrow A just before completion of the cutting operation. A quick feeding actuation lever 10 having the roller 10*a* is swung to rotate a quick feeding actuation lever shaft 11 which is integrated with the quick feeding actuation lever 10 and rotatably supported by the bed 9. With rotation of the quick feeding actuation lever shaft 11, a quick feeding actuation release lever 12 is swung so that a pin 13 of the quick feeding actuation release lever 12 forces a quick feeding actuation latch 14 rotatably supported by the bed 9 to rotate in the direction of the arrow B. As a result, a quick feeding actuation tooth stopper 15 provided on a stepped portion 14*a* of the quick feeding actuation clutch 14 is swung about a bolt 15*c* by a resilient force of a spring 16 in the direction of the arrow C whereby a recess 15*a* of the quick feeding actuation tooth stopper 15 engages with a quick feeding forked stepped screw 18 projected from an end of a quick feeding fork 17.

The quick feeding actuation tooth stopper 15 is driven via the crank 2'*a* of the quick feeding crank shaft 2' and a quick feeding tooth stopper crank 8 rotatably fixed to the bed 9 to move reciprocally in the direction of the arrow D—D' in the prescribed cycle. With the engagement of the recess 15*a* of the quick feeding actuation tooth stopper 15 and the quick feeding forked stepped screw 18, the quick feeding fork 17 and a quick feeding slide shaft 19 fixed to the quick feeding fork 17 slide together in the direction of the arrow D—D' relative to the bed 9 in the prescribed cycle. With the sliding operation of the quick feeding slide shaft 19, a stepped portion 21*a* of the quick feeding sliding shaft stopper 21 engages a corner 17*b* of the quick feeding fork 17 to prevent the quick feeding fork 17 from moving in the direction of the arrow D'. A spring 20 extends between a bracket 20*b* and the quick feeding fork 17. The bracket 20*b* is fixed to the quick feeding sliding shaft stopper 21 which is rotatably supported at the bed 9 at the one end thereof.

In this arrangement, when the quick feeding actuation tooth stopper 15 moves to the arrow D', the quick feeding actuation tooth stopper 15 is raised upward in the direction of the arrow E by the inclined surface 15*b* of the recess 15*a* and is returned in such manner as to be retained on the stepped portion 14*a* of the quick feeding actuation latch 14. At this time, the quick feeding fork 17 is moved in the direction of the arrow D.

With the motion of the quick feeding fork 17 toward the direction of the arrow D, a quick feeding clutch release sleeve 22 on the pattern wheel shaft 27' engaged with the quick feeding fork 17 slides in the direction of the arrow D so that a plurality of quick feeding clutch release levers 23 (three as shown in FIG. 4(*a*)), which have been moved outward by the quick feeding clutch release lever 22, are rotated about each shaft 23*a* in the direction of the arrow F. With the rotation of the quick feeding clutch release levers 23, each roller 24 pressed by the corresponding quick feeding clutch release lever 23 is pushed by the spring 25 and enters between the outer wheel 5*a* of the clutch and the cam surface of the quick feeding clutch roller carrier 26 to engage the clutch 5 whereby the quick feeding clutch roller carrier 26 fixed to the pattern wheel shaft 27' starts to rotate together with the outer wheel 5*a* of the clutch 5.

With engagement of the clutch 5, the other end 27'B of the pattern wheel 27 integrated with the quick clutch roller carrier 26 starts to rotate so that the pattern wheel 28 fixed to the pattern wheel shaft 27' is rotated. A work clamping carrier (not shown) slidably supported by the bed 9 is moved in accordance with the rotation of the pattern wheel 28 to feed the sewn cloth placed on a pair of base plates on the work clamping carrier whereby "FIRST QUICK FEEDING STEP" is carried out.

When "FIRST QUICK FEEDING STEP" causes rotation of the pattern wheel secured to the pattern wheel shaft 27', a cam 32 attached to the pattern wheel 28 causes a quick feeding sliding shaft moving stopper release arm 29 to swing in the direction of the arrow G to push down the tip end of the quick feeding sliding shaft moving stopper 21 whereby the stepped portion 21*a* is disengaged from the corner 17*b* of the quick feeding fork 17. As a result, the quick feeding sliding shaft 19 and the quick feeding fork 17 integrated therewith are moved in the direction of the arrow D' by the compression spring 30. Accompanied by this operation, the quick feeding clutch release sleeve 22 forces each quick feeding clutch release lever 23 to move outward in the direction of the arrow F' as shown in FIG. 4(*a*) to decrease the resilient force of the spring 25 so that each roller 24 is pressed inside whereby the clutch is disengaged to complete the "FIRST QUICK FEEDING STEP".

The "SECOND QUICK FEEDING STEP" is made to utilize a disengagement of the clutch of the lower shaft wherein the second quick feeding actuation lever 31 is raised to rotate the quick feeding actuation lever shaft 11 to thereby feed quickly the sewn cloth in the same manner as the "FIRST QUICK FEEDING STEP" thereafter. Completion of the "SECOND QUICK FEEDING STEP" is made in such manner that the cam 32 attached to the pattern wheel 28 rotates the quick feeding sliding shaft moving stopper release arm 29 in the direction of the arrow G and thereafter in the same manner as the "FIRST QUICK FEEDING STEP".

The "FIRST QUICK FEEDING STEP" and the "SECOND QUICK FEEDING STEP" in the conventional later perforation type sewing machine is described below with reference to FIGS. 3, 5 and 6.

The "FIRST QUICK FEEDING STEP" utilizes a closing lever 33 which is operated in the "CLOTH TENSIONING STEP". That is, a quick feeding actuation lever latch 36 rotatably attached to the tip end of the quick feeding actuation lever 34 secured to the quick feeding actuation lever shaft 11 is positioned and capable of engagement with the pin 33*a* projected from the lower end of the closing lever 33. First, at the time the sewn cloth is clamped by a clamping unit, (not shown) the closing lever 33 is swung to cause the pin 33*a* to push and rotate the quick feeding actuation lever latch 36 as shown in FIG. 6(*b*), then to move over the quick feeding lever latch 36 as shown in FIG. 6(*c*) while the quick feeding actuation lever latch 36 is quickly returned to the original position. This action causes contact with the stopper 35 by the return spring (not shown), so that the quick feeding actuation lever 34 per se does not swing. Next, at the time when the closing lever 33 is swung into the direction of the arrow H' to effect the "CLOTH TENSIONING STEP", the pin 33*a* at the right side of the quick feeding actuation lever latch 36 is moved toward the arrow H'. At this time, since the quick feeding actuation lever latch 36 is engaged with the stopper 35, the quick feeding actuation lever 34 is swung in the direction of the arrow I' to rotate the quick feeding actuation lever shaft 11. Thereafter, in the same manner as the "FIRST QUICK FEEDING STEP" of the earlier perforation type, the "FIRST QUICK FEEDING STEP" can be carried out. At the same time, the "SECOND QUICK FEEDING STEP" utilizes the disengagment of the clutch on the lower shaft (not shown) upon completion of the "SEWING OPERATION" for raising the second quick feeding actuation lever 31 as shown in FIG. 3 to rotate the quick feeding actuation lever shaft 11 whereby the "SECOND QUICK FEEDING STEP" is carried out in the same manner as that of the earlier perforation type machine.

However, the conventional quick feeding driving unit of either the earlier perforation type machine or the later perforation type machine requires a complex arrangement and much labor and time for assembly and adjustment thereof.

Furthermore, inasmuch as the quick feeding mechanism of the conventional sewing machine is used exclusively either for the earlier perforation type machine or the later perforation type machine, if the single sewing machine employs functions of both the earlier and the later perforation type machines, the quick feeding mechanism becomes more complicated.

SUMMARY OF THE INVENTION

The present invention has been made to solve the problems of the conventional quick feeding driving unit described above.

It is therefore an object of the present invention to provide a quick feeding driving unit in a perforating sewing machine having functions of earlier and later perforation type machines which is characterized by a simple uncomplicated structure.

Another object of the present invention is to provide a quick feeding driving unit in a perforating sewing machine which can be easily assembled and adjusted.

Yet another object of the present invention is to provide a quick feeding driving unit in a perforating sewing machine which increases the working efficiency, and improves the reliability and durability thereof.

Still another object of the present invention is to provide a quick feeding driving unit in a perforating sewing machine which can be shifted automatically from use in the earlier perforation type machine to the later perforation type machine or vice versa.

To achieve the above objects, the quick feeding driving unit according to the present invention comprises a quick feeding shaft rotatably supported by a bed of the perforating sewing machine. The quick feeding shaft is rotatable in one direction and has one end coaxially connected to a magnetic clutch shaft. The other end of the quick feeding shaft is coaxially connected to one end of a quick feeding shaft body. The other end of this shaft body has a worm. A magnetic clutch is secured coaxially to the magnetic clutch shaft. This magnetic clutch can engage the magnetic clutch shaft and the quick feeding shaft body to transmit a rotational driving force of the magnetic clutch shaft to the quick feeding shaft body. A pattern wheel shaft disposed at right angles with the quick feeding shaft is rotatably supported at one end thereof by the bed of the perforating sewing machine. The pattern wheel shaft has a pattern wheel at the other end thereof for feeding quickly a sewn cloth. A worm wheel shaft is coaxially fixed to the pattern wheel shaft 27. A worm wheel is coaxially secured to the pattern wheel shaft 27 at the intermediate portion thereof to mesh with the worm. The worm wheel and the worm constitute a gear mechanism to transmit the rotational driving force of the quick feeding body to the pattern wheel shaft.

The above and other objects, features and advantages of the present invention will become more apparent from the following description taken in conjunction with the accompanying drawings.

BRIEF DESCRIPTION OF THE DRAWINGS

FIG. 4(*b*) is a cross sectional view of the clutch of FIG. 4(*a*);

DESCRIPTION OF THE PREFERRED EMBODIMENT

Figure 1:
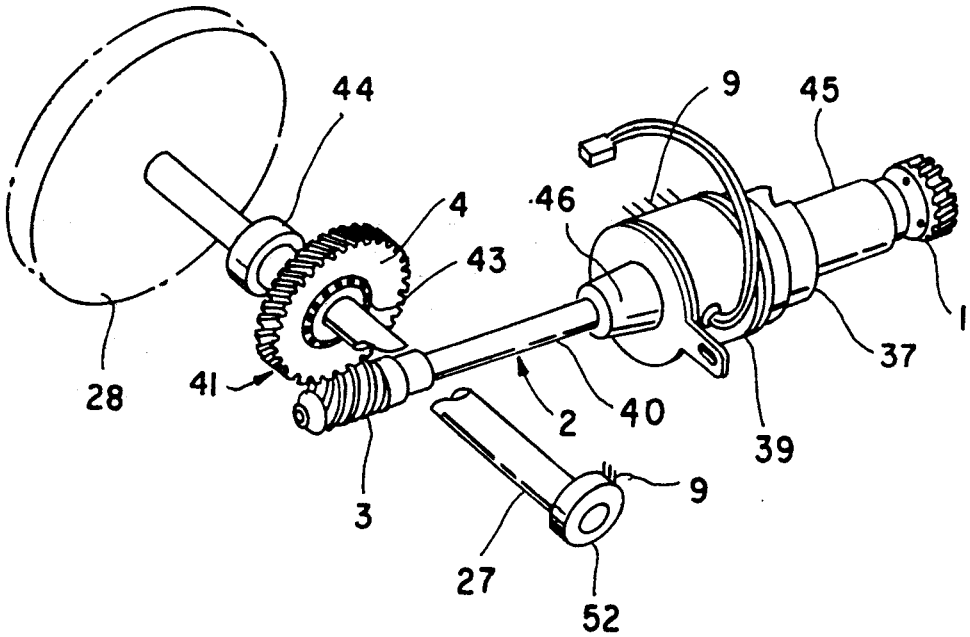
FIG. 1 is a perspective view of a main portion of a quick feeding driving unit in a perforating sewing machine according to an embodiment of the present invention.
Figure 2:
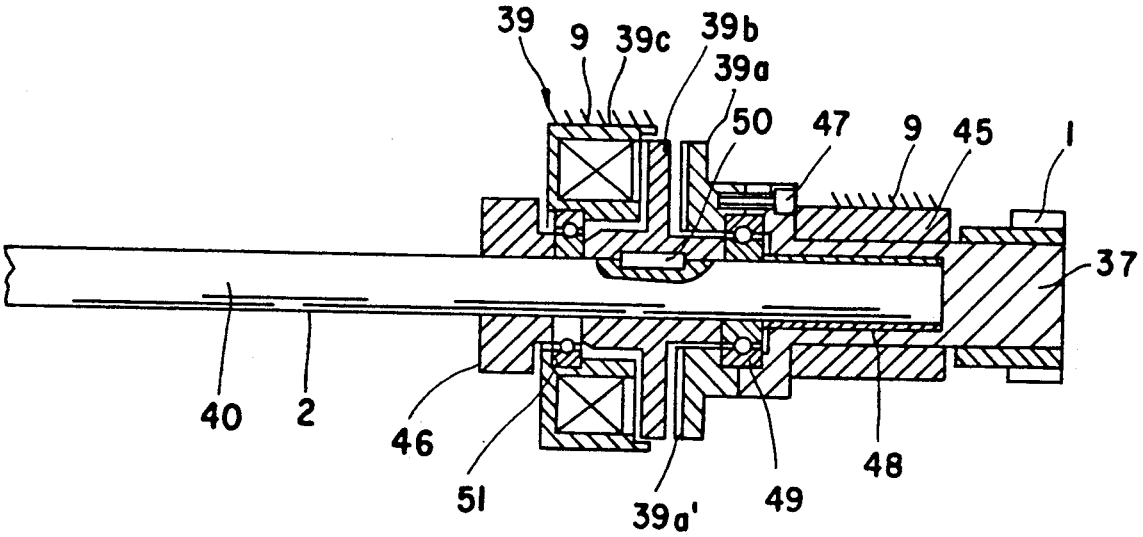
FIG. 2 is a cross sectional view of the quick feeding shaft of FIG. 1.
Figure 3:
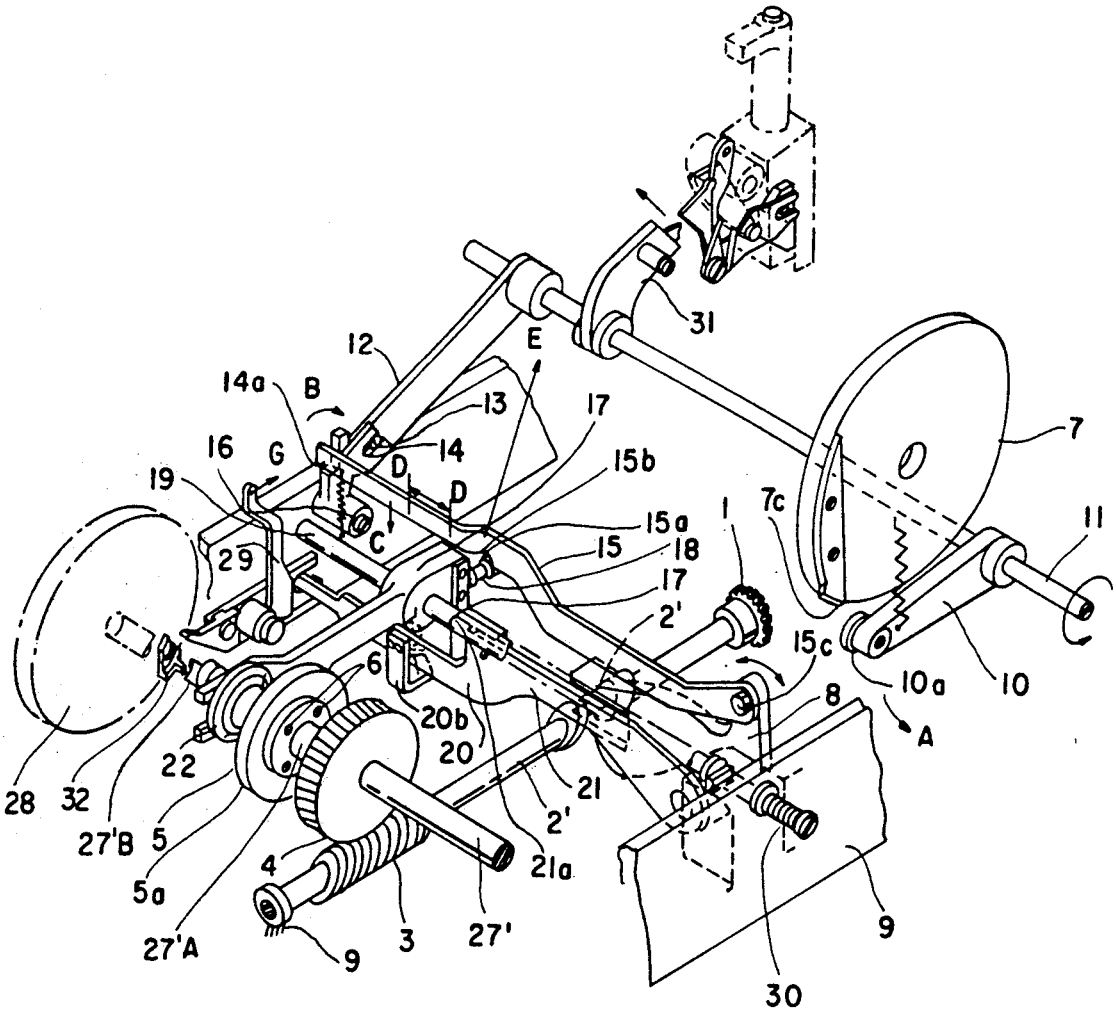
FIG. 3 is a perspective view of a prior art conventional quick feeding driving unit of an earlier perforation type sewing machine.
Figure 4:
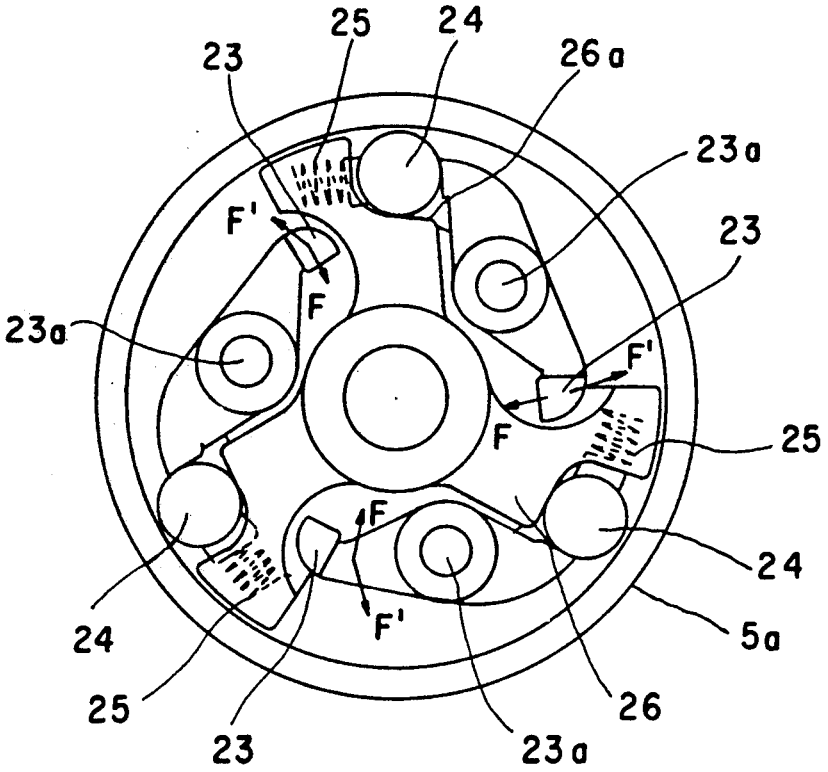
FIG. 4(*a*) is a view showing a clutch of FIG. 3.
Figure 5:
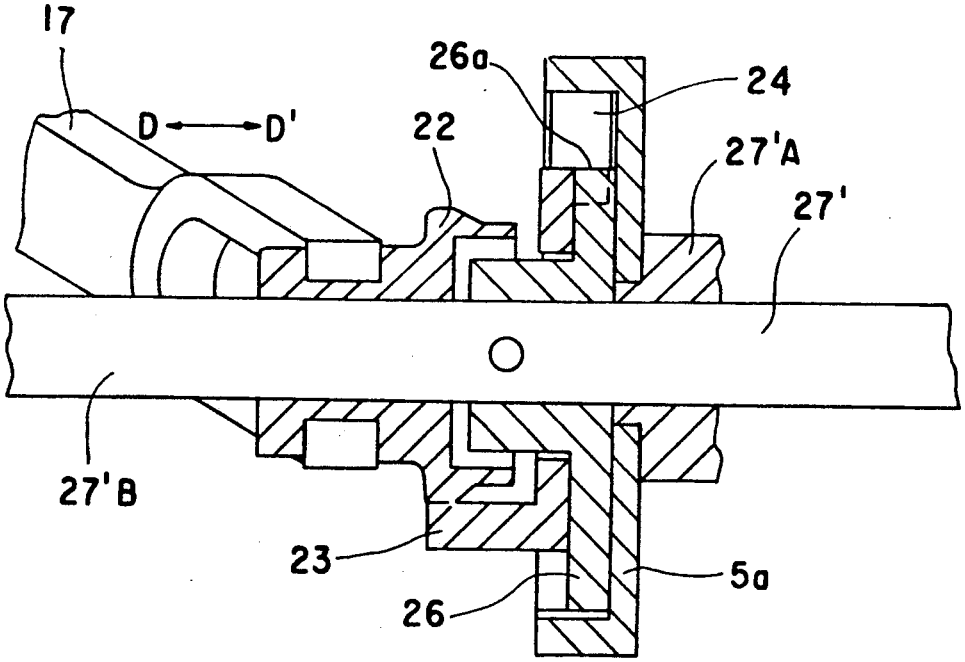
FIG. 5 is a perspective view of a prior art conventional quick feeding driving unit of a later perforation type sewing machine.
Figure 6:
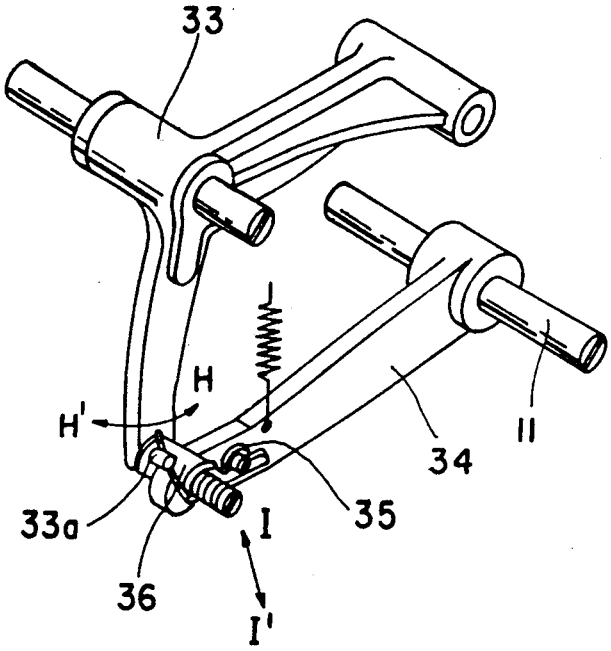
FIGS. 6(*a*), 6(*b*), 6(*c*) are views illustrating an operation of a prior art conventional quick feeding lever latch.
Figure 7:
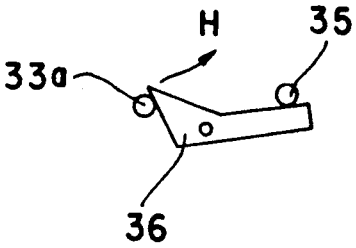
Figure 8:
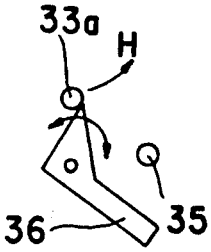
Figure 9:
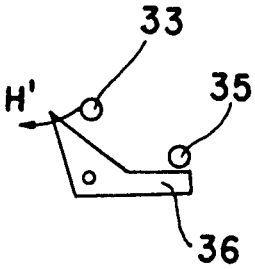

A quick feeding driving unit in a perforating sewing machine according to a preferred embodiment of the present invention is described below with reference to FIGS. 1 and 2.

A quick feeding driving unit in a perforating sewing machine comprises a quick feeding shaft 2 rotatably supported by a bed 9 of the perforating sewing machine. The quick feeding shaft 2 rotates in one way direction, having one end coaxially connected to a magnetic clutch shaft 37 and the other end coaxially connected to one end of a quick feeding shaft body 40 provided with a worm 3 at the other end. A magnetic clutch 39 is secured coaxially to the magnetic clutch shaft 37. The magnetic clutch 39 capable of engaging the magnetic clutch shaft 37 with the quick feeding shaft body 40 to transmit a rotational driving force of the magnetic clutch shaft 37 to the quick feeding shaft body 40. A pattern wheel shaft 27 is disposed at right angles with the quick feeding shaft 2 and is rotatably supported at one end thereof by the bed 9 of the perforating sewing machine. The pattern wheel shaft 27 having a pattern wheel 28 at the other end thereof for feeding quickly a sewn cloth. A worm wheel shaft 44 is coaxially secured to the pattern wheel shaft 27. A worm wheel 4 is coaxially secured to the pattern wheel shaft 27 at the intermediate portion thereof for meshing with the worm 3. The worm wheel 4 and the worm 3 constitute a gear mechanism 41 for transmitting the rotational driving force of the quick feeding body 40 to the pattern wheel shaft 27.

More in detail, rotatably supported on the bed 9 of the sewing machine are the quick feeding shaft 2 and the pattern wheel shaft 27 disposed at right angles with the quick feeding shaft 2. The quick feeding shaft 2 has one end coaxially connected to the magnetic clutch shaft 37 and the other end coaxially connected to the quick feeding shaft body 40. The magnetic clutch 39 is interposed between the magnetic clutch shaft 37 and the quick feeding shaft body 40 for transmitting the rotational motion of the quick feeding shaft 2 to the pattern wheel shaft 27.

That is, the magnetic clutch 37 is rotatably supported via a metal bearing 45 secured to bed 9. A quick feeding gear 1 is secured to one end of the magnetic clutch shaft 37. An armature 39*a* having washer 39*a*′ is secured to the other end of the magnetic clutch shaft 37 by the bolt 47. The quick feeding gear 1 is always rotatably driven in one direction by a rotational driving source (not shown). The quick feeding shaft body 40 has one end rotatably inserted into and supported by the hole defined in the other end of the magnetic clutch shaft 37 via a metal bearing 48, the portion adjacent to the one end being rotatably supported by an armature 39*a* via a ball bearing 49, the other end being secured to the worm 3. A rotor 39*b* is attached to the middle portion of the quick feeding shaft body 40 via a key 50 and is non-rotatable relative to the quick feeding shaft body 40. A field winding 39*c* is provided over the rotor 39*b* via a ball bearing 51 and is fixed to the bed 9 for constituting a magnetic clutch 39 in which the winding is stationary. The quick feeding shaft body 40 is rotatable relative to the field winding 39*c*. A ring 46 is provided on the quick feeding shaft body 40 adjacent to the field winding 39*c* by a set screw (not shown) for positioning the inside of the ball bearing 51.

The pattern wheel shaft 27 is rotatably supported via a bearing 52 by the bed 9 while the worm wheel shaft 44 is secured thereto. The one way directional clutch 43 is interposed between the worm wheel shaft 44 and the worm wheel 4 which is meshed with the worm 3 of the quick feeding shaft body 40. That is, when the field winding 39*c* is energized to cause the magnetic clutch 39 to be engaged with the quick feeding shaft 2 so that the worm 3 rotates the worm wheel 4 due to the rotation of the quick feeding shaft 2 in the one way direction. The one way directional clutch 43 is engaged with the worm wheel 4 so that the pattern wheel shaft 27 integrated with the worm wheel shaft 44 is rotated in one direction. The worm 3 and the worm wheel 4 constitute the gear mechanism 41 for transmitting the rotational driving force of the quick feeding shaft 2 to the pattern wheel shaft 27.

Operation of the quick feeding driving unit will be described hereinafter.

In the quick feeding driving unit used in the earlier perforation type machine or the later perforation type machine, when the "FIRST QUICK FEEDING STEP" or the "SECOND QUICK FEEDING STEP" is started, the field 39*c* is energized, causing the rotor 39*b* to attract the washer 39*a*′ of the armature 39*a* to engage the magnetic clutch 39 with the quick feeding shaft 2. With the engagement of the magnetic clutch 39, the rotational driving force of the magnetic clutch shaft 37 provided with the quick feeding gear 1 which is driven by the rotational driving source is transmitted to the quick feeding shaft body 40 via the magnetic clutch 39 whereby the worm wheel 4 is rotatably driven by the worm 3 to thereby engage the one way directional clutch 43. As a result, the pattern wheel shaft 27 is rotatably driven via the worm wheel shaft 44. Utilizing the rotation of the pattern wheel 28 provided at the pattern wheel shaft 27, a work clamping carrier slidably supported by the bed 9 is moved to thereby feed the sewn cloth placed on the pair of base plates mounted on the work clamping carrier. When the field winding 39*c* is deenergized, the magnetic clutch 37 is disengaged to complete the "FIRST AND SECOND QUICK FEEDING STEPS".

At the time of feeding the sewn cloth at a lower speed in the "SEWING STEP" than the feeding speed in the "FIRST AND SECOND QUICK FEEDING STEPS", the pattern wheel is rotated at a low speed by a means (not shown). At this time, the one way directional clutch is disengaged whereby the worm 3 is prevented from being rotated by the worm wheel 4. As a result, the worm 3 and the quick feeding shaft body 40 are prevented from rotating idly so that durability of the sewing machine is improved.

In the "CLOTH TENSIONING STEP", a detector detects any motion of mechanically movable components to engage the clutch to start the "FIRST QUICK FEEDING STEP" in any of the earlier and the later perforation type machines. Before going to the following "SEWING STEP", the detector detects any motion of the mechanically movable components so that the magnetic clutch 39 is disengaged to complete "FIRST QUICK FEEDING STEP". This operation can be automatized.

Upon completion of "SEWING STEP", the detector can detect any motion of the mechanically movable components to disengage the clutch to start the "SECOND QUICK FEEDING STEP", the detector detects that the work clamping carrier is returned to its original position to disengage the magnetic clutch 39 to complete the step. This operation can be automatized.

With the arrangement of the present invention having two functions of the earlier perforation type machine and the later perforation type machine, since the "FIRST AND SECOND QUICK FEEDING STEPS" can be effected in appropriate time, the quick feeding driving unit can be made with a simple structure whereby trouble rarely occurs and reliability and durability thereof are improved. The assembly and adjustment of the quick feeding driving unit can be made very simply so that the working efficiency is remarkably improved. Furthermore, it is possible to automatize in such manner as to easily switch from the earlier perforation type machine to the later perforation type machine or vice versa.

Although the invention has been described in its preferred form with a certain degree of particularity, it is to be understood that many variations and changes are possible in the invention without departing from the scope thereof.

What is claimed is:

1. A quick feeding driving unit for use in a perforating sewing machine having a bed and comprising:

a quick feeding shaft having two opposite ends;

a worm secured to one end of the quick feeding shaft;

said quick feeding shaft having a portion thereof rotatably supported in a bearing secured to said bed and rotatable in one direction;

a magnetic clutch having a stationary winding supported by the bed and a magnetic clutch shaft having two opposite ends, one end of the clutch shaft being coaxially operatively connected to the other end of the feeding shaft, the clutch, when the winding is energized, engaging the clutch shaft with the feeding shaft to transmit a rotational driving force of the clutch shaft to the feeding shaft;

a pattern wheel shaft having two opposite ends and disposed at a right angle to the quick feeding shaft and rotatably supported at one end thereof in a bearing secured at the bed;

a pattern wheel secured at the other end of the pattern wheel shaft for feeding a sewn cloth quickly;

a worm wheel coaxially fixed to the pattern wheel shaft at an intermediate portion thereof and meshing with said worm, the worm wheel and the worm constituting a gear mechanism for transmitting the rotational driving force of the quick feeding shaft to the pattern wheel shaft.

2. A quick feeding driving unit as set forth in claim 1 further comprising a one way directional clutch fixed to the pattern wheel shaft and interposed between the pattern wheel shaft and the worm wheel for meshing of the worm wheel with the worm for transmitting the one way directional rotational driving force of the quick feeding shaft to the pattern wheel shaft so that said pattern wheel shaft is rotated in said one way direction.

* * * * *